US006655551B2

(12) United States Patent
Manne

(10) Patent No.: US 6,655,551 B2
(45) Date of Patent: Dec. 2, 2003

(54) PORTABLE DISPENSER FOR MIXING AND DISPENSING FLUID MIXTURES

(76) Inventor: Joseph Manne, 128 St. Marks Pl.-Apt. 4B, New York, NY (US) 10009

( * ) Notice: Subject to any disclaimer, the term of this patent is extended or adjusted under 35 U.S.C. 154(b) by 41 days.

(21) Appl. No.: 10/003,992

(22) Filed: Nov. 2, 2001

(65) Prior Publication Data

US 2002/0053576 A1 May 9, 2002

Related U.S. Application Data

(60) Provisional application No. 60/245,549, filed on Nov. 3, 2000.

(51) Int. Cl.[7] ..... B67D 5/60; B67D 5/52

(52) U.S. Cl. ..... 222/145.6; 222/132; 222/137; 222/390; 222/235

(58) Field of Search ..... 222/132, 145.1, 222/145.5, 145.6, 135, 137, 390, 233, 235; 366/279, 289; 416/75

(56) References Cited

U.S. PATENT DOCUMENTS 887,790 A * 5/1908 Griswold ..... 30/123
1,025,798 A * 5/1912 Fitch ..... 366/343
3,570,719 A 3/1971 Schiff
3,774,816 A 11/1973 Bratton
4,006,841 A 2/1977 Alticosalian
4,061,248 A 12/1977 Arena
4,546,922 A 10/1985 Thometz
4,549,674 A 10/1985 Alticosalian
4,736,872 A 4/1988 Ryder et al.
4,993,594 A 2/1991 Becker et al.
5,289,835 A 3/1994 Harlan et al.
5,554,197 A 9/1996 Assini et al.
5,778,901 A 7/1998 Abrahamian
5,833,121 A 11/1998 Gueret
5,862,947 A 1/1999 Wiegner et al.

* cited by examiner

*Primary Examiner*—Pedro Philogene
*Assistant Examiner*—Stephanie Willatt
(74) *Attorney, Agent, or Firm*—Muserlian, Lucas and Mercanti, LLP

(57) ABSTRACT

The portable dispenser has individual supply chambers that communicate with a mixing chamber. Each of the supply chambers has a doser to move fluid compositions from the supply chamber to the mixing chamber. The mixing chamber has a mixer to allow it to form a homogeneous mix of the individual compositions. An applicator is used to output the homogeneous mix.

6 Claims, 5 Drawing Sheets

PORTABLE DISPENSER FOR MIXING AND DISPENSING FLUID MIXTURES

This application claims the benefit of U.S. Provisional Application No. 60/245,549 filed Nov. 3, 2000.

BACKGROUND OF THE INVENTION

1. Field of the Invention

The present invention relates to a dispenser and, more particularly, to a portable dispenser which forms a homogeneous mixture from individual fluid compositions. The portable dispenser of the present invention is especially applicable to personal care products such as toothpaste, shampoos and cosmetics.

2. Prior Art

Portable dispensers which form a mixture from individual fluid compositions are known, see U.S. Pat. No. 4,993,594. Portable dispensers for cosmetic compositions are also known, however, they do not have the ability to form mixtures from individual cosmetic compositions.

Consumers want the ability to formulate their own personal care products on-the-spot and there is a need for a portable dispenser which can formulate personal care products on-the-spot.

SUMMARY OF THE INVENTION

A portable, lightweight dispenser has now been discovered which allows for on-the-spot mixing and dispensing of individual fluid compositions. The present invention allows two or more different individual, fluid compositions to be mixed to form a homogeneous fluid mixture which can then be dispensed and used immediately by the consumer. This dispenser is especially useful for personal care products.

Broadly, the present invention relates to a portable dispenser which comprises:

(a) an elongated shell wherein the shell has a top and a bottom end;

(b) two or more supply chambers housed in said shell and abutting the bottom end of said shell;

(c) two or more individual compatible fluid compositions, one of each of said individual fluid compositions housed in one of each of said supply chambers;

(d) one mixing chamber housed in said shell at said top end of said shell, said mixing chamber in fluid communication with each of said supply chambers, and said mixing chamber being accessible from outside said shell through the top end of said shell;

(e) two or more dosage means, one associated with each of said supply chambers, for individually measuring out a set amount of said individual compositions and moving said measured amount of said individual compositions to said mixing chamber; and (f) a mixing means associated with said mixing chamber for mixing the individual compositions and forming a homogeneous fluid mixture.

Suitable fluid mixtures which can be formed using the present invention include fluid personal care products such as cosmetics, dentifrices, hand and body creams and lotions, soaps and shampoos, hand and hair conditioners, hair gels and styling preparations, suntan lotions and sun screens, deodorants, perfumes, shaving creams, and hair dyes or colors. Cosmetics which can be formulated with the present invention include lipstick, eye shadow, facial foundation, eyeliner, and fingernail polish. As pointed out, both the individual composition and the mixture formed from the compositions must be in a fluid form.

The term fluid as used in the written description and claims means a gas, liquid or solid which can flow between the supply chamber and the mixing chamber and be mixed in the mixing chamber to form a homogeneous fluid mixture. The fluid must have viscosity to allow it to flow from the supply chamber into the mixing chamber. Thus, certain powders can be employed because they readily flow and can be mixed. Certain waxes flow when subjected to pressure and can also be mixed.

The amount of each individual composition dosed into the mixing chamber can be determined by the user since each supply chamber has its own dosage means and the dosage means are controlled by the user. Each supply chamber has a dosage means associated therewith that allows the user to determine the amount of each composition to add to the mixing chamber. Each dosage means is separately and individually controlled and are not interconnected. Thus, the user must specifically add the amount of each individual composition each time they decide to formulate the mixture. This provides greater flexibility to the user. The individual can make their own determination of how much to add, or they can use a chart which shows the amount of each individual composition to add to the mixing chamber to form a predetermined mixture. Such a chart could be available in printed form or over the Internet.

The chambers are separately loaded with the individual compositions and the user is able to change the supply chambers either as they become empty or as they choose in order to use different individual compositions and increase their choices of the mixtures.

BRIEF DESCRIPTION OF THE DRAWINGS

These and other aspects of the present invention may be more fully understood by reference to one or more of the following drawings wherein.

DETAILED DESCRIPTION OF THE INVENTION

Figure 1:
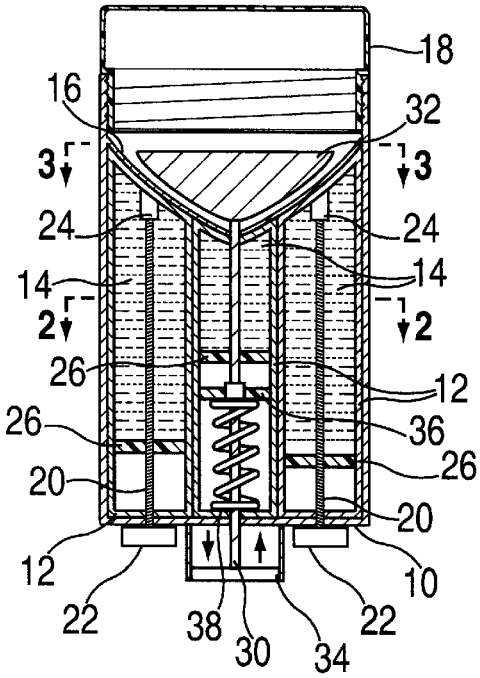
FIG. 1 is a side view of the dispenser of the present invention.

Turning to FIG. 1, the dispenser of the present invention has a hard elongated shell 10 housing three supply chambers 12. Inside each supply chamber 12 is fluid composition 14. The top of each supply chamber is in fluid communication with mixing chamber 16. Housed on top of mixing chamber 16 is screw top 18. Screw top 18 is removed to provide access to the homogeneous fluid mixture in mixing chamber 16.

Each supply chamber 12 is equipped with rod 20 which extends from screw cap 22 at the bottom of chamber 12 to fixed cap 24 at the top of chamber 12. Fixed cap 24 allows rod 20 to rotate thereon. Rod 20 is threaded and movable base 26 has a negative thread which allows movable base 26 to move upwards and downwards by means of rotating screw cap 22. At the top of each chamber 12 are holes 28 which extend through to mixing chamber 16. The holes allow fluid composition 14 to move from chamber 12 to mixing chamber 16.

In order to mix the individual fluid compositions in mixing chamber 16, mixing shaft 30 is affixed to stir bar 32, which is housed in mixing chamber 16. At the other end of mixing shaft 30 is actuator button 34. Mixing shaft 30 is held in place by support plate 36. Housed between support plate 36 and actuator button 34 is a coil spring 38. Mixing shaft 30 is threaded such that when actuator button 34 is pressed upward, it causes stir bar 32 to rotate in one direction. When the actuator button is released, coil spring 38 causes actuator button 34 to move downward and for stir bar 32 to be rotated in the opposite direction.

As shown in FIGS. 1, 2, 3, and 4, shell 10 is cylindrical in shape and supply chambers 12 are cylindrical in shape but have a slanted top which mates with the bottom of mixing chamber 16. As shown in FIG. 5, the interior of shell 10 can be divided into two or more compartments and these compartments can be used as supply chambers 12.

Figure 2:
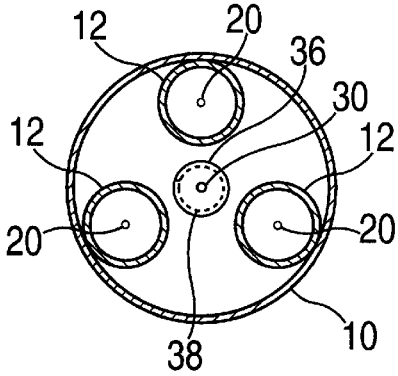
FIG. 2 is a top view of the dispenser taken through lines 2—2 of FIG. 1.
Figure 3:
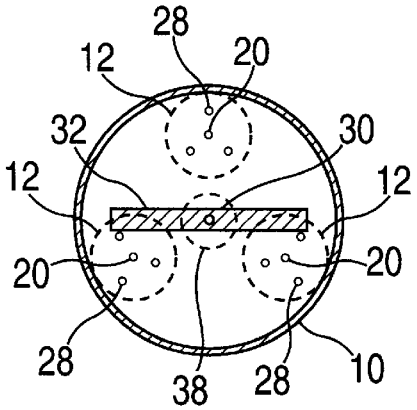
FIG. 3 is a top view of the dispenser taken through lines 3—3 of FIG. 1.
Figure 4:
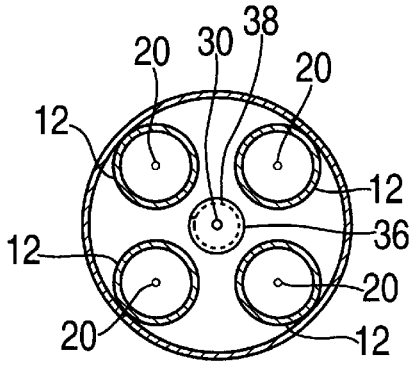
FIG. 4 is a top view of the dispenser having four supply chambers.
Figure 5:
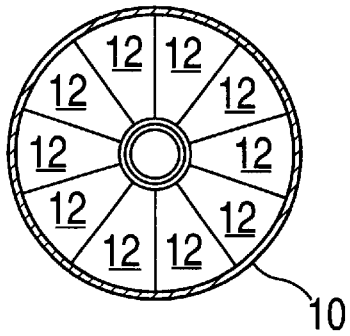
FIG. 5 is a top view of the dispenser with ten (10) supply chambers.
Figure 8:
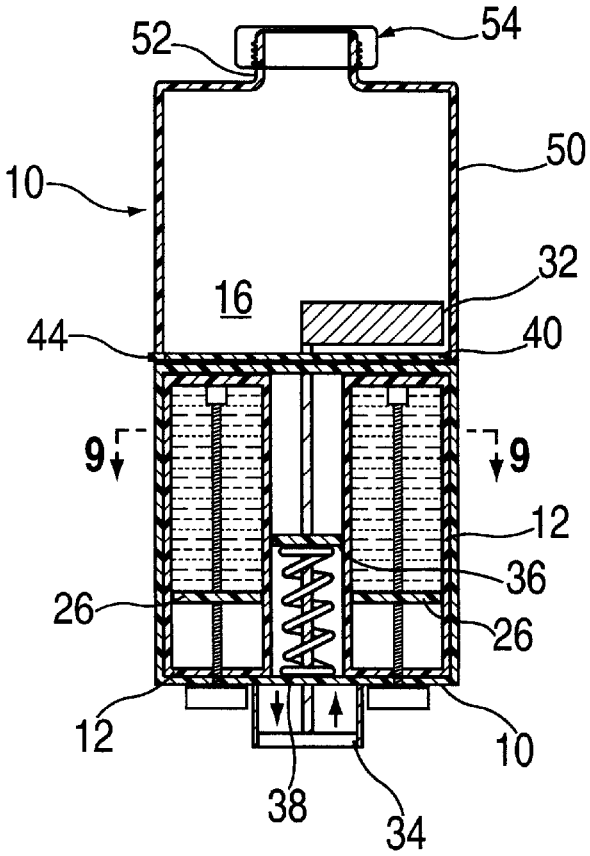
FIG. 8 is a cross-section of another embodiment of the dispenser of the present invention.

The number of supply chambers can vary, FIG. 2 illustrates three (3) supply chambers, FIG. 4 illustrates four (4) supply chambers, while FIG. 5 illustrates ten (10) supply chambers. As will be discussed later, FIG. 8 illustrates two (2) supply chambers. The preferred number of supply chambers will depend upon the intended purpose of the dispenser. When the color of the final mix is critical, it is preferred to employ at least three (3) supply chambers.

Screw cap 22 is preferably a thumb wheel with numbers mounted on the outside from 0 to 10 and evenly spaced thereon. By having the numerical designation on the outside, the user can control the amount of each of the cosmetic compositions added to mixing chamber 16. Since rod 20 is threaded and movable base 26 has a negative thread thereon, the rotation of screw cap 22 causes the movable base 26 to move upward and push cosmetic composition 14 through holes 28 into mixing chamber 16.

Removing screw top 18 from mixing chamber 16 opens the top of mixing chamber 16 and allows access to the homogeneous fluid mixture contained in mixing chamber 16. The user can then employ a finger or other applicator for removing the mixture from the mixing chamber.

In the embodiment of FIG. 1, screw top 18 can house an applicator such as a brush or a paddle which is used to apply the cosmetic to the user. Such an applicator can be housed on a telescoping pole that resides inside top 18 when not in use or can be on a pole that causes the applicator to extend down into mixing chamber 16. Alternatively, a lip on the top of mixing chamber 16 can be used to prevent the applicator from extending downward into the mixing chamber during periods of non-use.

Figure 7:
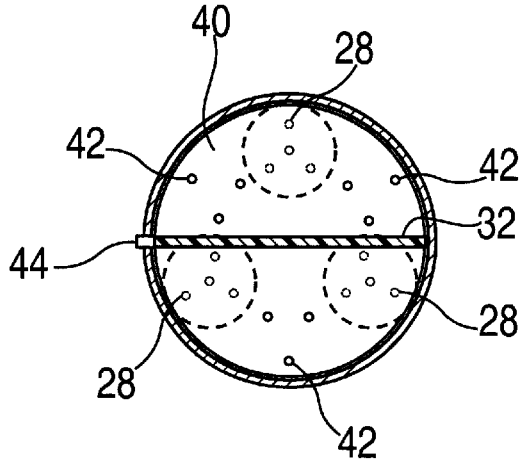
FIG. 7 is a top view of FIG. 6 taken along lines 7—7.
Figure 6:
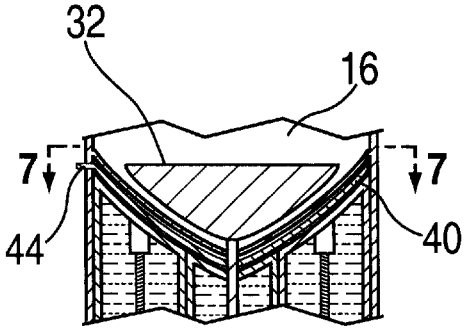
FIG. 6 is a side view of the dispenser with a shut-off plate positioned between the mixing chamber and the supply chamber.

In an alternative embodiment shown in FIGS. 6 and 7, the dispenser is equipped with plate 40 that is positioned in the bottom of mixing chamber 16. Plate 40 is rotatable in the bottom of mixing chamber 16. Plate 40 rotates in order to close holes 28. Plate 40 has a series of holes 42 which align with holes 28 in the bottom of mixing chamber 16. As shown in FIG. 7, holes 42 are out of alignment with holes 28. By rotating lever 44, the holes 42 are aligned with holes 28 and allow fluid composition 14 to flow from supply chambers 12 into mixing chamber 16. When lever 44 is rotated such that holes 42 do not align with holes 28, then no fluid composition 14 can flow between the two chambers.

Figure 9:
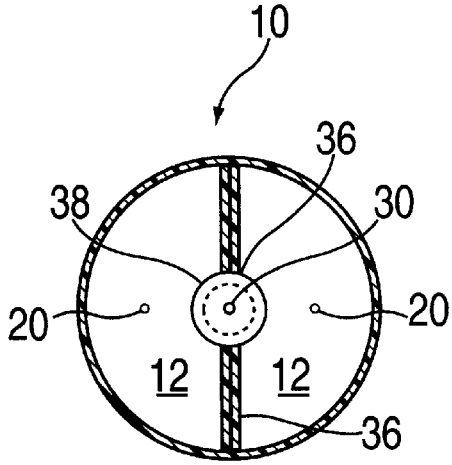
FIG. 9 is a top view of the dispenser taken along lines 9—9 of FIG. 8.

FIG. 8 illustrates a side view of another preferred embodiment for the dispenser of the present invention while FIG. 9 is a top view taken along lines 9—9 of FIG. 8. In the embodiment in FIGS. 8 and 9, there are two supply chambers 12. As shown in FIG. 9, the bottom portion of shell 10 is divided in half into two supply chambers 12. Each supply chamber has movable base 26 which forces the fluid contents of supply chambers 12 upward into mixing chamber 16 in the same manner as described above. Plate 40 is positioned in mixing chamber 16 and rotates by means of lever 44 about shaft 30 to open fluid communication between supply chambers 12 and mixing chamber 16 by way of holes 28 and 42, not shown.

In FIG. 8, shell 10 in the area of mixing chamber 16 has flexible side walls 50 to allow the homogeneous mixture formed in mixing chamber 16 to be squeezed out of mixing chamber 16 and through outlet 52 covered by screw top 54.

Flexible side walls 50 return to their original shape after being pressed inward.

Stirring bar 32 is depicted as a single bar extending horizontally out from shaft 30. Stirring bar 32 can be in any shape and size so long as it does not interfere with the contraction of side walls 50 and the squeezing of the mixture out of mixing chamber 16.

Screw top 54 is removed to allow for the mixture to exit mixing chamber 16. In the case of toothpaste, shampoo, and soap, outlet 52 is a single hole having a diameter equal to outlet 52. In the case of deodorant, outlet 52 is divided into a plurality of holes to provide a reduced flow of deodorant through outlet 52 and to provide a broad surface area with which to apply the deodorant.

As shown in FIG. 1, the top of each of the supply chambers is shaped so as to fit against the base of the mixing chamber and to allow for fluid communication between the supply chamber and the mixing chamber. Alternatively, supply chambers 12 can be separate from shell 10 and completely removable from the interior of shell 10. When supply chambers 12 are removable from shell 10, hole 28 can be a pipe which lances the top of the removable supply chamber, see FIG. 10. Such a pipe allows for fluid communication between the removable supply chamber and the mixing chamber.

Additionally, when the supply chambers are removable, the dosage means can either be built into the supply chamber, or rod 20 is telescoping with movable base 26 abutting the top of rod 20 such that as rod 20 is elongated, base 26 moves upward forcing fluid composition out into mixing chamber 16. As another alternative, the supply chamber has a hole extending downward the entire length of the supply chamber in which rod 20 resides and rod 20, screw cap 22 and movable base 26 are removable. In such an embodiment, supply chamber 12 has a donut-shaped cross-section.

Figure 10:
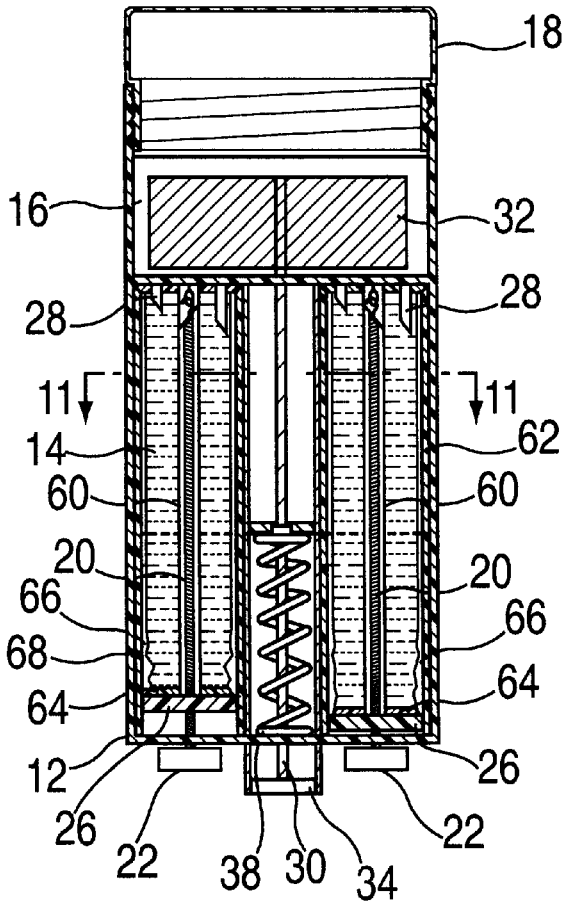
FIG. 10 is a side view of the dispenser with a replaceable, donut-shaped supply chamber.
Figure 11:
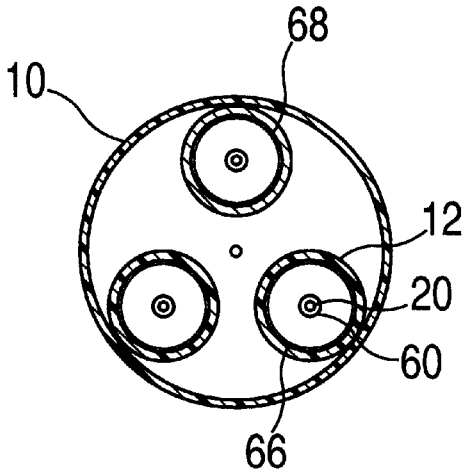
FIG. 11 is a top view of the dispenser taken along lines 11—11 of FIG. 10.

FIG. 10 illustrates a side view of the dispenser with a removable supply chamber 62 having a hole 60 therethrough while FIG. 11 is a top view of the dispenser of FIG. 10 taken along lines 11—11. From above, supply chamber 62 has a donut-shaped cross-section because of hole 60 in the middle through which shaft 20 resides. In FIG. 10, holes 28 are illustrated as hollow lances which puncture the top of replaceable supply chamber 62. Stir bar 32 is illustrated as a double-blade paddle.

As shown in FIG. 10, rod 20 is removably connected to fixed cap 24 by a hook-and-eye arrangement such that rod 20, along with movable base 26 and screw cap 22, are removed from the dispenser to allow removable supply chamber to be inserted therein. Then, rod 20, movable base 26, and screw cap 22 are inserted into hole 60 and the top of rod 20 attached to fixed cap 24 such that rod 20, screw cap 22 and movable base 26 are suspended from fixed cap 24. The bottom of removable supply chamber 62 has a break-away base 64 and collapsible inner wall 66. Outer wall 68 is rigid and forms a good seal with movable base 26. The hook-and-eye arrangement allows rod 20 to be held stationary while movable base 26 compresses the fluid in chamber 62.

Figure 12:
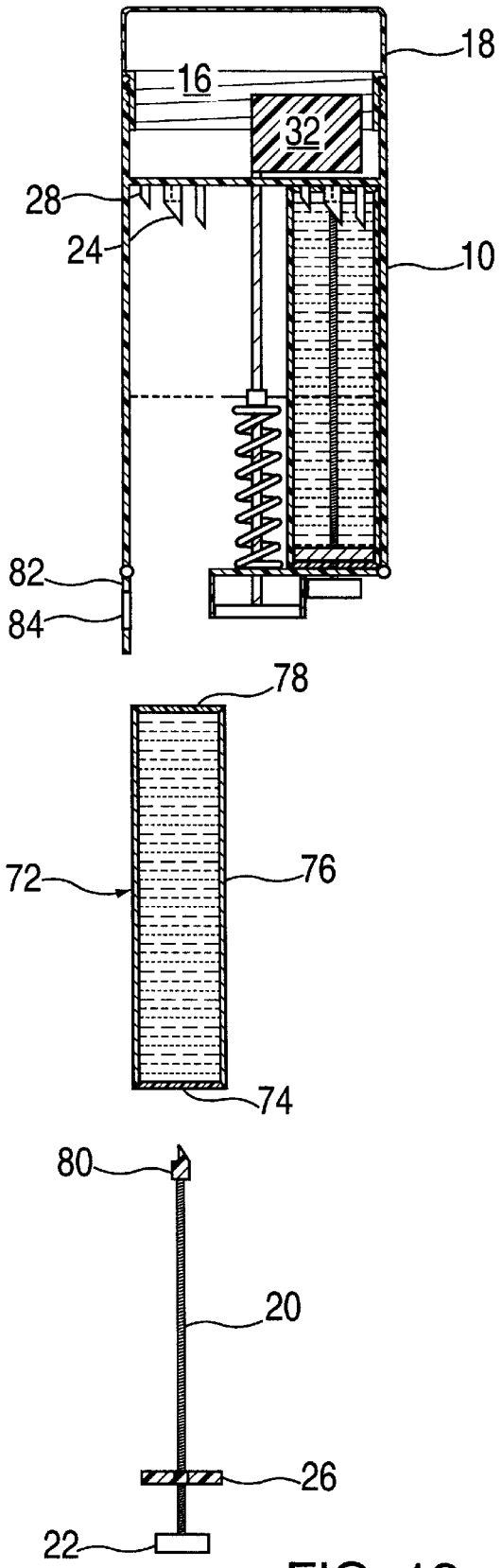
FIG. 12 is a side view of the dispenser with removable supply chambers and a shell as a frame.

Alternatively, as shown in FIG. 12, rod 20 along with screw cap 22 and movable base 26, are removable while fixed cap 24 is not. In this embodiment, removable supply chamber 72 has a break-away base 74, rigid side walls 76 and a puncturable top 78. Break-away base 74 is also able to be punctured by end 80 of rod 20. Holes 28 are hollow lances which puncture top 78 and provide fluid communication between the contents of supply chamber 72 and mixing chamber 16. Rod 20 has a pointed key end 80 which mates with a slot in fixed cap 24 in a conventional manner and which is pointed to lance through bottom 74. Fixed cap 24 is also pointed to allow it to puncture top 78 and cap 24 and end 80 mate in a key-slot manner so as to fix rod 20 and maintain rod 20 in an axially fixed manner to allow rod 20 to rotate and movable base 26 to move upward forcing fluid composition 14 through hollow lance 28 and into mixing chamber 16.

In the base of shell 10, there is trap door 82 which is hinged to the side wall of shell 10 and which has a slot 84 for rod 20 to reside in. Slot 84 extends to one of the edges of trap door 82 to allow rod 20 to be placed therein when trap door 82 is shut.

Other arrangements for the connection between rod 20 and fixed cap 24 can be used. Also, a tight seal is necessary between movable base 26 and side walls 76.

The walls of shell 10 and the walls of supply chamber 12 and mixing chamber 16 can be one and the same. Alternatively, shell 10 need not have a solid wall but can be a frame which houses the various components. Where shell 10 is a frame, the mixing chamber and supply chambers need to have solid walls because of the fluid nature of the components that they house. In the situation where supply chamber 12 is removable, removable supply chamber 12 will have its own solid walls and that portion of shell 10 adjacent supply chamber 12 can be a frame without solid walls.

For cosmetic compositions, the dispenser is preferably small. A preferred outside diameter of the shell is 3 cm. The stir bar has a diameter slightly less than the diameter of the mixing chamber, for example, 2.7 cm. This allows clearance for the rotation of the stir bar in the mixing chamber. The preferred diameter of each of the supply chambers is 0.7 cm and a height of approximately 3 cm.

The dispenser of the present invention can be used in a number of areas. The following are a number of examples where the dispenser can be used.

Cosmetics

The dispenser of the present invention can be used for mixing different colored cosmetic compositions to arrive at a desired color. For example, lipstick is sold in a myriad of colors. In accordance with the present invention, two or more, and preferably three or four, different colored fluid cosmetic compositions are loaded into the individual supply chambers and then metered out to the mixing chamber based on the final color that the user wants.

The color of the cosmetic compositions are preferably the primary colors, i.e. blue, red, and green, or red, yellow, and blue. This allows the user to form any number of shades or colors of a cosmetic composition. Alternatively, the cosmetic composition can have more uniform colors such as a bright red, a rose, and a deep red, which would allow for more subtle color combinations of the cosmetic composition.

Since each one of the supply chambers has an associated dosage means, the user either chooses based on a color chart or based on their own eye (empirically), the amount of each of the cosmetic composition to add to the mixing chamber.

Once the proper dosage has been added to the mixing chamber, a mixing means, which is associated with the mixing chamber, is employed to form a homogeneous mixture. The individual compositions must be compatible so that when they are mixed, a homogeneous mixture is formed.

The cosmetic compositions are compatible in that they are all of the same type of cosmetic composition, the only difference being the color. Thus, for example, each of the supply chambers can house a different colored lipstick. Because the supply chamber has a dosage means, the appropriate amount of each cosmetic composition is then dosed into the mixing chamber and, when the mixing means mixes the individual cosmetic compositions, they form a homogeneous colored mixture.

Thus, the present invention produces any desired colored cosmetic by adjusting the amount of the individual cosmetic composition of different colors that is dosed into the mixing chamber.

In an alternative embodiment, a fourth supply chamber can be employed in the present invention wherein the fourth composition comprises a cosmetic enhancer which is also dosed in and added to the mixing chamber and subsequently mixed in with the other individual cosmetic compositions to form a homogeneous cosmetic mixture. These cosmetic enhancers will depend, to a certain extent, on the type of cosmetic composition that is in the supply chambers. For example, for a nail polish, nail hardener or sparkle is contained in the fourth chamber. For facial foundation or lipstick, a moisturizer or sun block can be included as a cosmetic enhancer. Obviously, moisturizer or sun block can be combined into one and included in the fourth chamber. Furthermore, a perfume or scented fluid can be included in the fourth chamber to add a scent to the final cosmetic composition.

For lipstick, eye shadow, facial foundation, the user can use their finger to apply the mix. The user unscrews the dispenser port and uses their finger to apply the mix. For nail polish, a specific applicator is housed in the cap and is employed to paint the mixture onto the nails.

Personal Hygiene

The dispenser of the present invention can also be used for mixing different personal hygiene compositions to arrive at the desired mixture. In this case, each one of the supply chambers houses a different individual fluid composition that is added to the mixing chamber so as to form the desired mixture. For example, different suntan lotions having different blocking or prevention factor (conventionally referred to as Sun Protection Factor or SPF) ratings can be used along with a moisturizer or different scented fluids. For toothpaste, one chamber can have a cleaning composition, the second chamber a whitening composition, and the third chamber a flavor such as mint, regular, bubble gum. The shampoo can have the base soap in one chamber, fragrance such as pine, lilac, rose, in the second chamber, and the third chamber houses a conditioner. For hand soap, the three chambers can hold scent, base soap, and a hand conditioner. For deodorant, the chambers can house a deodorant base, a fragrance, and a skin softener. For hand lotion, the chambers can contain a base, a skin softener, and a scent. These are just examples of the types of individual compositions that can be employed to form the homogeneous mixture.

The dispenser port will vary depending on the type of composition. For most of the personal hygiene products, a squeeze spout is employed.

It will be understood that the claims are intended to cover all changes and modifications of the preferred embodiments of the invention herein chosen for the purpose of illustration which do not constitute a departure from the spirit and scope of the invention.

What is claimed is:

1. A portable dispenser comprising:

(a) an elongated shell, said shell having a top and bottom end;

(b) two or more supply chambers housed in said shell and abutting said bottom end of said shell;

(c) two or more individual compatible fluid compositions, one of each of said individual fluid compositions housed in one of each of said supply chambers;

(d) one mixing chamber housed in said shell at said top end of said shell, said mixing chamber in fluid communication with each of said supply chambers, and said mixing chamber accessible from outside said shell through the top end of said shell;

(e) two or more dosage means, one associated with each of said supply chambers, for measuring out a set amount of said individual compositions and moving said measured amount of said individual compositions to said mixing chamber, each of said dosage means separately and individually controlled and not interconnected; and (f) a mixing means associated with said mixing chamber for mixing the individual compositions and forming a homogeneous fluid mixture.

2. The dispenser of claim 1 wherein said homogeneous fluid mixture is selected from the group consisting of nail polish, lipstick, eye shadow, facial foundation, and eyeliner.

3. The dispenser of claim 1 wherein said homogeneous fluid mixture is selected from the group consisting of dentifrices, hand and body creams and lotions, soaps and shampoos, hand and hair conditioners, hair gels and styling preparations, sun tan lotions and sun screens, deodorants, perfumes, shaving creams and hair dyes or color.

4. The dispenser of claim 1 wherein each of said dosage means comprises:

a rotatable screw cap mounted at said bottom end of said shell;

a fixed cap mounted at said top end of said supply chamber, said fixed cap having one or more holes therein which are in fluid communication with said mixing chamber;

a threaded rod rotatably mounted at said top end in said fixed cap and fixed at said bottom end in said screw cap; and a movable base mounted on said threaded rod and having a negative thread so that rotation of said screw cap causes said movable base to move along said threaded rod.

5. The dispenser of claim 1 wherein said mixing means comprises:

a mixing shaft extending from said bottom end of said shell to said mixing chamber, said mixing shaft being threaded at said bottom end;

a stir bar affixed to said mixing shaft at said top end of said mixing shaft, said stir bar being positioned in said mixing chamber;

an actuator button rotatably mounted on the threaded end of said mixing shaft, said actuator button being positioned at said bottom end of said shell;

a support plate positioned in said shell between said top end and said bottom end of said shell, said support plate rotatably holding said mixing shaft;

a coil spring positioned around said mixing shaft and between said support plate and said actuator button, wherein when said actuator button is depressed, said stir bar is rotated in one direction and when said actuator button is released, said coil spring causes said actuator button to move outward and said stir bar to rotate in the other direction, thereby mixing said individual compositions and forming said homogeneous composition.

6. The dispenser of claim 1 further comprising:

a third supply chamber, said third supply chamber housing a fluid composition, said third supply chamber being in fluid communication with said mixing chamber; and a third dosage means associated with said third supply chamber.

* * * * *